US006464452B2

(12) United States Patent
Iwane

(10) Patent No.: US 6,464,452 B2
(45) Date of Patent: Oct. 15, 2002

(54) VACUUM PUMP

(75) Inventor: Matsumi Iwane, Komoro (JP)

(73) Assignee: Kashiyama Kougyou Industry Co., Ltd., Tokyo (JP)

( * ) Notice: Subject to any disclaimer, the term of this patent is extended or adjusted under 35 U.S.C. 154(b) by 0 days.

(21) Appl. No.: 09/816,373

(22) Filed: Mar. 26, 2001

(65) Prior Publication Data

US 2002/0025249 A1 Feb. 28, 2002

(30) Foreign Application Priority Data

Aug. 25, 2000 (JP) ..... 2000-256542

(51) Int. Cl.[7] ..... F04D 17/06
(52) U.S. Cl. ..... 415/72; 415/90
(58) Field of Search ..... 415/72, 90, 136, 415/137, 138, 143

(56) References Cited

U.S. PATENT DOCUMENTS 4,797,062 A * 1/1989 Deters et al. ..... 415/177
4,806,074 A * 2/1989 Burger et al. ..... 415/72
4,822,251 A * 4/1989 Amrath et al. ..... 415/118
4,826,393 A * 5/1989 Miki ..... 415/143
5,052,887 A * 10/1991 Novikov et al. ..... 415/90
5,924,841 A * 7/1999 Okamura et al. ..... 415/176

* cited by examiner

*Primary Examiner*—Edward K. Look
*Assistant Examiner*—Richard A. Edgar
(74) *Attorney, Agent, or Firm*—Armstrong Westerman & Hattori, LLP

(57) ABSTRACT

In the case of a vacuum pump, having a screw groove, of the present invention, a rotor is disposed inside a stator with an extremely small clearance provided in-between, under which condition the rotor is designed to rotate at a high speed. The upper and lower end faces of the aforementioned stator are supported with sliding members interposed in-between, thereby enabling the stator to perform sliding rotation. Between the stator and a pump housing is provided a clearance r. In the event that stress corrosion cracking occurs to the rotor, then part of the rotor comes into contact with the stator, thereby causing the stator to be deformed radially outward. Even when such deformation takes place, the stator rotates together with the rotor, since the clearance r is provided on the outside periphery of the stator, with the result that consequent rotational friction causes the rotor to decelerate. Therefore, even when stress corrosion cracking occurs to the rotor, it is possible to prevent the housing from being fractured.

13 Claims, 5 Drawing Sheets

VACUUM PUMP

BACKGROUND OF THE INVENTION

1. Technical Field of the Invention

The present invention relates to a vacuum pump used in a semiconductor manufacturing process or the like. More specifically, the present invention relates to a vacuum pump having a screw groove formed:

either on the inside periphery of a cylindrical stator;

or on the outside periphery of a rotor disposed in the interior of the stator; wherein gas flowing between the stator and the rotor is compressed by rotating the rotor at a high speed.

Examples of the aforementioned vacuum pump having a screw groove include: a screw type vacuum pump; and a multiple-type vacuum pump which is a combination of a screw type vacuum pump and a turbo-molecular pump: both of which have heretofore been used.

2. Prior Art

In a semiconductor manufacturing process, a vacuum pump is used for the purpose of keeping a reaction chamber in a high vacuum and of discharging reaction byproducts. A vacuum pump used for the aforementioned purpose is required to be capable of being used in a wide pressure range.

One known vacuum pump capable of being used in a wide pressure range as mentioned above is a screw type vacuum pump. In the case of a screw type vacuum pump, a screw groove is formed either on the inside periphery of a cylindrical stator or on the outside periphery of a rotor disposed in the interior of the stator, and the rotor is rotated at a speed as high as tens of thousands of revolutions per minute. The rotor is disposed such that the pertinent clearance between the rotor and the stator is 0.2 mm to 1.0 mm, or so, which is extremely small.

With such a screw type vacuum pump, gas is caused to flow in the direction of the axis along the screw groove between the rotor and the stator, owing to the viscosity of gas, resulting in gas being compressed.

Such a screw type vacuum pump has an excellent gas exhaustion capacity, particularly in a low-vacuum range (a vacuum range close to atmospheric pressure). In a high-vacuum range, however, it is often the case that a multiple-type vacuum pump, which is a combination of a screw type vacuum pump and a turbo-molecular pump, is used, since the gas exhaustion speed is somewhat low in the aforementioned range.

PROBLEMS ASSOCIATED WITH THE AFOREMENTIONED PRIOR ART

Incidentally, with a semiconductor manufacturing process, it is often the case that foreign matter such as powder of reaction byproducts is included in the gas exhausted from a reaction chamber, and in the event that a vacuum pump is used, the aforementioned foreign matter is liable to stick to, and to deposit on, the inner surface of the vacuum pump. In particular, in the case of a screw type vacuum pump, foreign matter such as powder is liable to deposit in the clearance between then rotor and the stator, since the aforementioned clearance is designed to be extremely small as mentioned above. Therefore in the event that the stator is fixed, there is a danger that the rotor, when rotating at a high speed, engages with the stator, with foreign matter interposed in-between, resulting in instantaneous locking. Such instantaneous locking of the rotor causes the rotor and the stator to be damaged.

Such being the case, an arrangement has been contrived wherein the stator is supported in such a way as to permit rotation with respect to the housing, thereby allowing the stator to rotate together with the rotor upon engagement of the rotor with the stator, with the result that the rotational speed of the rotor decreases gradually owing to the rotational resistance of the stator (refer to JPN. U.M. Appln.Koukoku 6-40954 for an example).

As regards a prior art screw type vacuum pump, even in a case where the stator is permitted to rotate as mentioned above, the degree of fit pertaining to the stator and the housing is such that the outside periphery of the stator and the inside periphery of the housing are well-nigh in contact with each other when the aforementioned pump is used.

PROBLEMS TO BE SOLVED

However, in a semiconductor manufacturing process, it is often the case that a corrosive gas is used, with the result that stress corrosion cracking or creep rupture occurs to the rotor. Cracks due to phenomena such as stress corrosion cracking occurs in the direction of the axis of the rotor. When such a crack occurs, the rotor becomes deformed during high-speed rotation such that its diameter expands owing to centrifugal force, thereby causing the rotor to come into contact with the stator, which is disposed around the rotor, with the result that the stator is deformed radially outward. This being so, in the event that the stator and the housing are well-nigh in sliding contact with each other, then the stator is pressed against the inner surface of the housing, thus making it impossible for the stator to rotate with respect to the housing, with the result that the rotor becomes locked instantaneously, leading to fracturing of the rotor owing to the resulting rotational inertia force. In the worst case, the stator becomes broken through, resulting further in failure of the housing as well.

In order for such failure of the housing to be prevented, the housing should be so designed as to have sufficient strength. However, for the purpose of doing so, it is necessary to enlarge the housing wall thickness, leading to a problem in that the weight of the vacuum pump increases.

In view of the aforementioned problem, it is an object of the present invention to obtain a light-weight vacuum pump which has a screw groove and whose housing does not fail even when the rotor becomes fractured during high-speed rotation.

SUMMARY OF THE INVENTION

For the purpose of attaining the aforementioned object, the present invention provides a vacuum pump (1, 101, or 201, as applicable) wherein a sufficiently large clearance (r) is provided between a cylindrical housing (2) and a stator (8 or 108 as applicable) which is supported inside the housing (2) in such a way as to permit rotation.

Namely, the vacuum pump (1, 101, or 201, as applicable) according to the present invention comprises: a cylindrical stator (8 or 108 as applicable) which is provided inside a housing (2) and which is supported in such a way as to permit circumferential sliding; and a rotor (22 or 122 as applicable) which is provided inside the stator (8 or 108 as applicable) in such a way as to permit free rotation and which is set in rotational motion by a motor (18+21): wherein a screw groove is formed either on the inside periphery of the stator (8 or 108 as applicable) or on the outside periphery of the rotor (22 or 122 as applicable); and a clearance (r) which is large enough to allow the stator (8 or 108 as applicable) to be deformed radially outward is provided between the stator (8 or 108 as applicable) and the housing (2).

OPERATION OF THE INVENTION

Since a sufficiently large clearance is provided between the stator (8 or 108 as applicable) and the housing (2) as mentioned above, in the event that the rotor (22 or 122 as applicable) becomes fractured or deformed during high-speed rotation, causing part of the rotor (22 or 122 as applicable) to come into contact with the stator (8 or 108 as applicable), which in turn becomes deformed radially outward, even then the stator (8 or 108 as applicable) is prevented from coming into contact with the housing (2), thus permitting the stator (8 or 108 as applicable) to rotate, so long as the amount of radially outward deformation of the stator (8 or 108 as applicable) is smaller than the aforementioned clearance (r). Contacting of the rotor (22 or 122 as applicable) with the stator (8 or 108 as applicable) causes the stator (8 or 108 as applicable) to start rotating together with the rotor (22 or 122 as applicable), and the rotational speed of the rotor (22 or 122 as applicable) decreases gradually owing to the rotational friction of the stator (8 or 108 as applicable).

The longer the time is during which the aforementioned rotor (22 or 122 as applicable) and the aforementioned stator (8 or 108 as applicable) continue to rotate together with each other until the stator (8 or 108 as applicable) comes into contact with the housing (2) subsequent to the rotor (22 or 122 as applicable) hitting the stator (8 or 108 as applicable), the larger the amount of energy is which is absorbed owing to the rotational friction of the stator (8 or 108 as applicable) (or the larger the amount of rotational energy is which is converted into thermal energy).

As regards the aforementioned clearance (r), in the event that $r \geqq 0.5$ mm or so for example, even then the rotational speed can be reduced through the absorption of the rotational energy, of the aforementioned rotor (22 or 122 as applicable) and of the aforementioned stator (8 or 108 as applicable), caused by the rotational resistance of the stator (8 or 108 as applicable) which is provided until such time as the stator (8 or 108 as applicable) comes into contact with the housing (2). By letting $r \geqq 1$ mm, an increased amount of energy can be absorbed owing to the rotational resistance of the stator (8 or 108) which is provided until such time as the stator (8 or 108 as applicable) comes into contact with the housing (2).

Therefore the larger the aforementioned clearance (r) is, the longer the time is which is required for the aforementioned stator (8 or 108 as applicable) to come into contact with the aforementioned housing (2), resulting in all the larger amount of energy being absorbed owing to the aforementioned rotational resistance. The larger the amount of energy is which is absorbed as mentioned above, the lower the level is to which the rotational speed of the rotor (22 or 122 as applicable) and of the stator (8 or 108 as applicable) drops when the stator (8 or 108 as applicable) comes into contact with the housing (2), thereby increasing the effectiveness in preventing the housing (2) from being fractured. Accordingly by providing the aforementioned clearance (r), the rotor (22 or 122 as applicable) is prevented from being severely fractured, thus precluding the stator (8 or 108 as applicable) from being broken through and moreover preventing the phenomenon of even the housing (2) being fractured.

DETAILED DESCRIPTION OF THE PREFERRED EMBODIMENTS OF THE INVENTION

Figure 1:
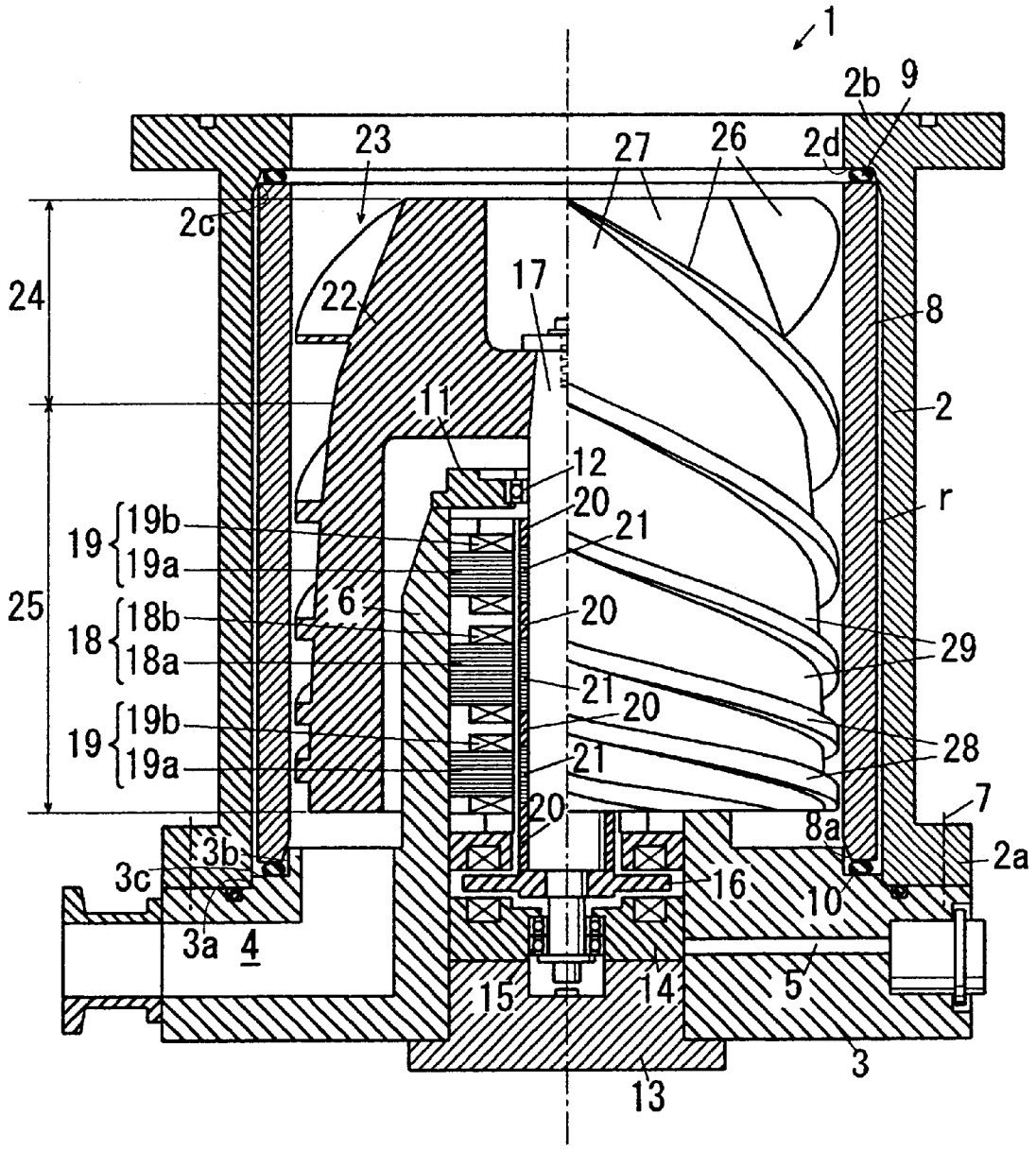
FIG. 1 is a longitudinal sectional view of the vacuum pump of the first embodiment of the present invention.

Referring to the drawings, the embodiments of the present invention are described below.

First Embodiment

FIG. 1 is a longitudinal sectional view showing an example (first embodiment) of a vacuum pump, having a screw groove, of the present invention.

The screw type vacuum pump 1 shown in FIG. 1 is provided with a cylindrical housing 2 and a base 3 which closes the lower end face of the housing 2. In the base 3 is provided a gas exhaust port 4 on one side and a power supply cable insertion hole 5 on the other side. In the central part of the base 3 is provided a cylindrical bearing support 6 which protrudes upward. The housing 2 has a lower end flange 2*a* and an upper end flange 2*b*, and is fixed on the base 3 by using a bolt 7 to fasten the lower end flange 2*a* to the base 3.

Inside the housing 2 is disposed a cylindrical stator 8 with a clearance of approximately 1 mm provided around the entire periphery. Namely, a clearance r is provided between the stator 8 and the housing 2.

Furthermore, on the top face of the aforementioned base 3 are formed an outer annular step 3*a* and an inner annular step 3*b* in coaxial alignment with each other.

The outer annular step 3*a* is used as a housing positioning portion 3*a*, which serves to position and support the lower end (one axial end) of the cylindrical housing 2 in a plane perpendicular to the axis, and the inner annular step 3*b* is used as a stator positioning portion 3*b* whose outside periphery serves to position and support the lower end (one axial end) of the cylindrical stator 8 in a plane perpendicular to the axis. Furthermore, on the periphery of aforementioned stator positioning portion 3*b* is formed an annular stator support face 3*c*.

On the inside periphery of the lower end portion of the aforementioned cylindrical stator 8 is formed a conical tapered face 8*a* such that the inside diameter of the cylindrical stator 8 increases with diminishing distance from the lower end thereof. The stator 8 is positioned on the base 3 such that the tapered face 8*a* is brought into contact with the aforementioned stator positioning portion 3*b*.

On the bottom face of the aforementioned upper end flange 2*b* of the housing 2 are provided: a positioning engagement portion 2*c* formed by a conical face which engages with the upper end of the outside periphery of the aforementioned stator 8 to position the upper end of the stator 8; and a horizontal annular stator pressing face 2*d*.

The top face of the stator 8 is supported by the stator pressing face 2*d* of the housing 2 with an O-ring-shaped sliding member 9 interposed in-between, and the bottom face of the stator 8 is supported by the stator support face 3*c* of the housing 2 with a similar sliding member 10. Therefore when the bolt 7 is tightened to fix the housing 2 on the base 3, the stator 8 is pressed from above and from below with the sliding members 9 and 10 interposed in-between. However, the arrangement is such that the stator 8 is capable of sliding circumferentially, while subjected to frictional resistance, when a circumferential force is applied to the stator 8.

At the upper end of the bearing support 6 provided in the central part of the base 3 is installed an upper bearing 12 with an annular support member 11 interposed in-between. Furthermore, at the lower end of the bearing support 6 is installed a closing member 13 which serves to close the lower end opening of the bearing support 6. On the closing member 13 is mounted a lower bearing support member 14 which is annular and in whose central part is installed a lower bearing 15. Furthermore, on the top face of the bearing support member 14 is provided a magnetic thrust bearing 16.

Moreover, a rotary shaft 17 disposed in the central part of the bearing support 6 is supported by the upper bearing 12, the lower bearing 15, and the magnetic thrust bearing 16 in such a way as to permit free rotation.

In the vertical central part of the inner surface of the bearing support 6 is installed a motor magnetic field generation member 18 comprising four magnetic cores 18*a* which are disposed at equal spaces along the circumference of the inner surface of the bearing support 6 and four coils 18*b* each of which is wound around the periphery of one of the magnetic cores 18*a* (only one magnetic core 18*a* and only one coil 18*b* are shown in FIG. 1). Moreover, a pair of electromagnets 19 and 19 each comprising four magnetic cores 19*a* which are disposed at equal spaces along the circumference of the inner surface of the bearing support 6 similarly to the above and four coils 19*b* each of which is wound around the periphery of one of the magnetic cores 19*a* (only one magnetic core 19*a* and only one coil 19*b* are shown in FIG. 1) are provided such that one electromagnet 19 and the other electromagnet 19 are disposed above and below the motor magnetic field generation member 18, respectively. On the other hand, four stainless cylindrical members 20 and three magnetic material cylindrical members 21 are installed alternately in the direction of the axis on the outside periphery of the rotary shaft 17. Each of the three magnetic material cylindrical members 21 is disposed at a position opposite to one of the aforementioned magnetic cores 18*a,* 19*a,* and 19*a*.

Each of the coils 18*b* and 19*b* is so designed as to be supplied with power by means of a power supply cable installed through the power supply cable insertion hole 5.

Thus a motor (18+21) which serves to set the rotary shaft 17 in rotational motion is composed of the motor magnetic field generation member 18 and of the magnetic material cylindrical members 21 which are disposed opposite to the motor magnetic field generation member 18, and a radial magnetic bearing (19+21) is composed of the pair of electromagnets 19 and 19 which are disposed above and below the motor magnetic field generation member 18, respectively, and of the magnetic material cylindrical members 21 which are disposed opposite to the pair of electromagnets 19 and 19.

A rotor 22 is fixed on the upper end of the rotary shaft 17. The rotor 22, which consists of a cylindrical lower portion and a conical upper portion is so designed as to be disposed between the stator 8 and the bearing support portion 6 of the base 3.

On the periphery of the rotor 22 is formed a gas transfer portion 23, which consists of a turbo-molecular type gas transfer portion 24 (a portion wherein it is possible to calculate the amount of transferred gas on the basis of the design theory regarding turbo-molecular type pumps) on the upstream side (in the upper part in FIG. 1) and of a screw type pump gas transfer portion 25 (a portion wherein it is possible to calculate the amount of transferred gas on the basis of the design theory regarding screw type pumps) on the downstream side.

Moreover, as regards a vacuum pump wherein such a rotor 22 is adopted, a detailed description is omitted herein, since a patent for such a pump was already applied for separately by the present applicant (JPN. Pat. Application 11-375417).

The turbo-molecular type gas transfer portion 24 consists of a plurality of vanes 26 which are inclined with respect to the axis of the rotor 22 and of a plurality of grooves 27 each of which is formed between two adjacent vanes 26. Furthermore, the screw type pump gas transfer portion 25 consists of a screw thread 28 and a screw groove 29 which is formed at the foot of the screw thread 28 such that a screw groove trough as represented in a longitudinal section of the screw groove 29 is located between two adjacent screw thread ridges as represented in a longitudinal sectional view of the screw thread 28. The vanes 26 and the grooves 27 in the turbo-molecular type gas transfer portion 24 are so formed as to be continuous with the screw thread 28 and the screw groove 29 in the screw type pump gas transfer portion 25, respectively.

Thus the arrangement is such that when the rotor 22 is rotating, gas is transferred downward from above, as viewed in FIG. 1.

The turbo-molecular type gas transfer portion 24 and the screw type pump gas transfer portion 25 are designed on the basis of the design theory regarding turbo-molecular type pumps and of the design theory regarding screw type pumps, respectively, wherein the clearance between the inside periphery of the stator 28 and the tips of the vanes 26 on the rotor 22, as well as the clearance between the inside periphery of the stator 8 and the tip of the screw thread 28 on the rotor 22, is designed to be extremely small. Moreover, as regards a vacuum pump wherein such a rotor 22 is adopted, a detailed description is omitted herein, since a patent for such a pump was already applied for separately by the present applicant (JPN. Pat. Application 11-375417).

Operation of First Embodiment

The operation of the vacuum pump 1 of the first embodiment, whose construction is as described above and which is provided with a screw groove, is now described.

When power is supplied to the coils 18*b* of the motor magnetic field generation member 18, a rotating magnetic filed is generated to apply torque to the magnetic material cylindrical member 21, with the result that the rotary shaft on which the cylindrical member 21 is installed is set in high-speed rotational motion. Therefore the rotor 22 rotates at a high speed. In the meantime, the axial displacement of the rotary shaft 17 is corrected by the magnetic thrust bearing 16, and the displacement perpendicular to the axis of the rotary shaft 17 is corrected by the magnetic radial bearing (19+21). Accordingly the rotor 22 rotates at a fixed position at all times.

When the rotor 22 rotates at a high speed, the gas inside the gas transfer portion 23 is transferred downward from above, as viewed in FIG. 1. Therefore gas is sucked through the upper part of the housing 2, and moves downward while compressed, to be discharged through the gas exhaust port 4 provided in the base 3.

In the event that any foreign matter is caught between the stator 8 and the tip (or tips) of one (or more) of the vanes 26 or between the stator 8 and the screw thread 28 when the rotor 22 is rotating, then the rotor 22 and the stator 8 engages with each other, resulting in a braking force being applied to the rotor 22. In the event that the aforementioned engagement occurs to the vacuum pump 1, then the stator 8 rotates together with the rotor 22, since the stator 8 is permitted to slide circumferentially. Then the rotor 22 decelerates gradually to come to a stop, since rotational resistance is exerted on the stator 8 by the sliding members 9 and 10. Thus the rotor 22 is prevented from being locked instantaneously, thereby precluding consequent damage to components such as the rotor 22.

Furthermore, in the event that stress corrosion cracking or the like occurs to the rotor 22, then during rotation, the rotor 22 may become deformed to enlarge the diameter thereof In the event that the rotor 22 comes into contact with the stator 8 under such a condition, then it follows that the stator 8 also becomes deformed radially outward. In the event that the stator 8 and the housing 2 are well-nigh in sliding contact with each other, then it follows that the stator 8 is pressed against the inner surface of the housing 2, thus preventing the stator 8 from rotating with respect to the housing 2, with the result that the rotor 22 becomes locked instantaneously.

However, in the case of the vacuum pump 1 of the first embodiment, a clearance r of approximately 1 mm is provided between the stator 8 and the housing 2, and therefore it takes some time for the stator 8 to be deformed to the extent of coming into contact with the inner surface of the housing 2, and the stator 8 rotates together with the rotor 22 until such time as the stator 8 comes into contact with the inner surface of the housing 2. Besides, the friction produced between the stator 8 and the sliding members 9 and 10 as a result of the rotation of the stator 8 causes the kinetic energy of the rotor 22 to be consumed. Furthermore, when the stator 8 comes into contact with the inner surface of the housing 2 after starting to be deformed, the friction produced between the stator 8 and the housing 2 adds to the rotational resistance of the stator 8. Therefore the rotor is sufficiently decelerated before the stator 8 is pressed against the inner surface of the housing 2.

Thus fracturing of the rotor 22 due to abrupt stoppage thereof is prevented, and in the absence of the aforementioned fracturing, the rotor 22 is prevented from being broken through and moreover the phenomenon of even the housing (2) being fractured is prevented.

Second Embodiment

Figure 2:
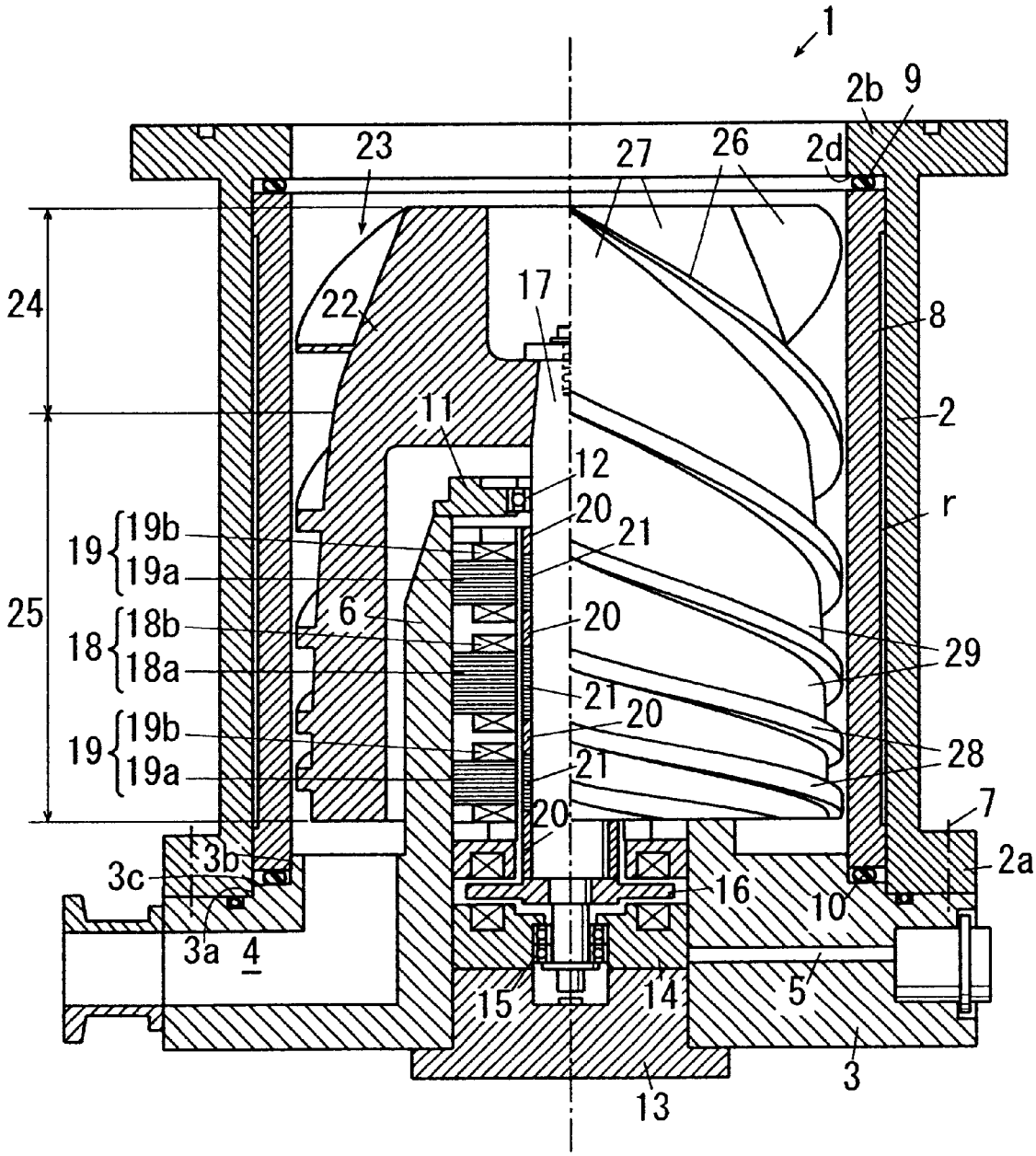
FIG. 2 is a longitudinal sectional view of the vacuum pump of the second embodiment of the present invention.

FIG. 2 is a longitudinal sectional view showing the second embodiment pertaining to a vacuum pump to which the present invention is applied.

In the case of the vacuum pump 1 of the second embodiment, the positioning engagement portion 2*c* of the housing 2 and the tapered face 8*a* of the stator 8, all of which pertain to the aforementioned first embodiment, are omitted, and on the stator 8, a flange whose diameter is 1 mm larger than the diameter of the longitudinally intermediate part of the stator 8 is provided on the outside periphery of each of the upper end and of the lower end.

The outside peripheries of the aforementioned flanges at the upper end and the lower end of the stator 8 are loosely fitted, with some clearance provided, to the inner periphery of the housing 2. A sliding member 9 is disposed between the upper end of the aforementioned stator 8 and a stator pressing face 2*d* of the housing 2, and a sliding member 10 is disposed between the lower end of the stator 8 and a stator support face 3*c* of a base 3.

The other portions of the construction of the second embodiment are similar to the corresponding portions of the construction of the first embodiment.

The operation performed by the second embodiment is similar to that carried out by the first aforementioned embodiment.

Third Embodiment

Figure 3:
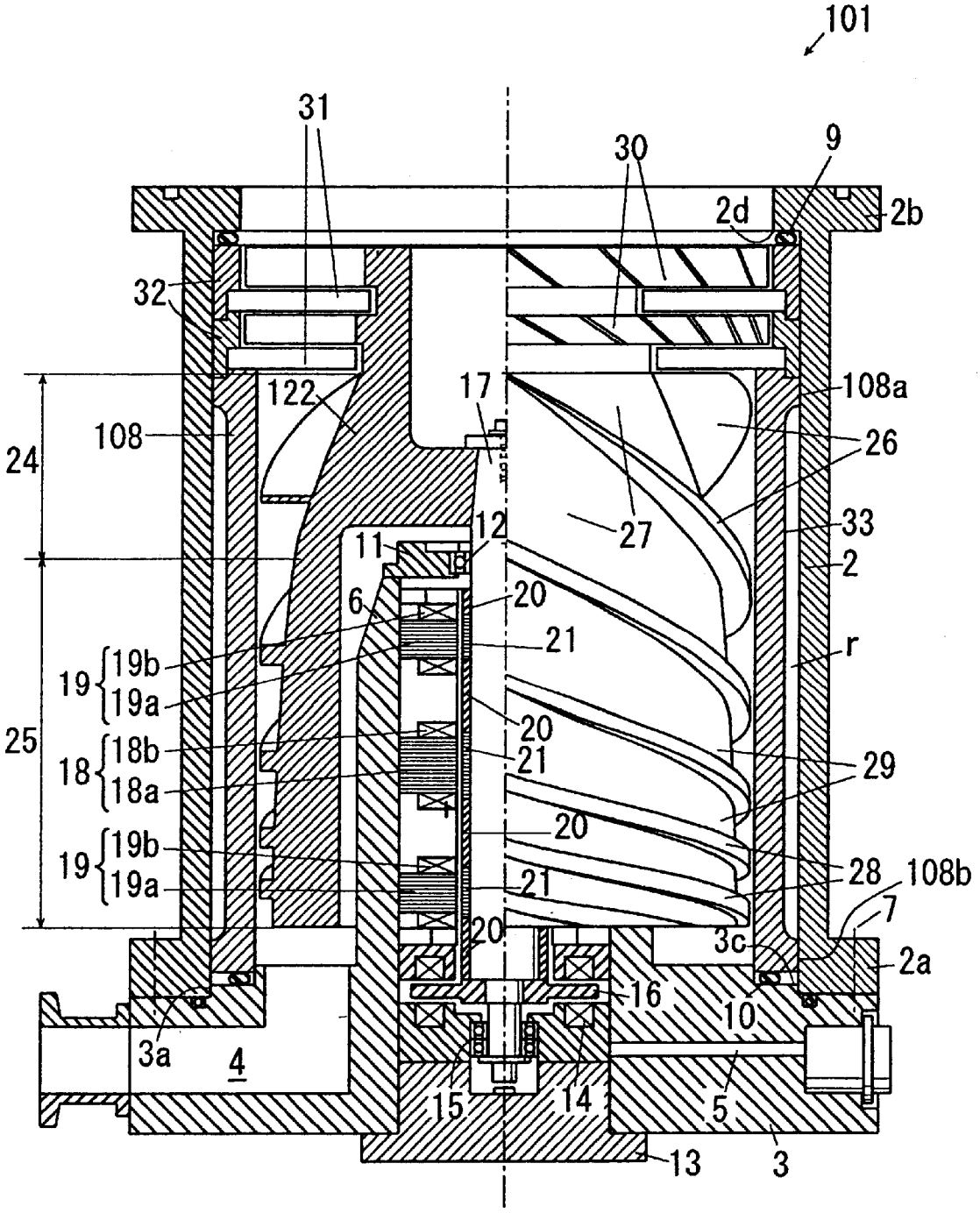
FIG. 3 is a longitudinal sectional view of the vacuum pump of the third embodiment of the present invention.

FIG. 3 is a longitudinal sectional view showing the third embodiment pertaining to a vacuum pump to which the present invention is applied.

This vacuum pump 101 is a multiple-type vacuum pump wherein a turbo-molecular pump is added to the vacuum pump, having a screw groove, described in FIG. 1. Namely, rotor vanes 30 of the turbo-molecular pump are provided at the upstream end of a rotor 122, and stationary vanes 31 are provided on the inner surface of the upper end of the housing 2. Moreover, the stator pressing face 2*d* formed on the bottom face of the upper end of the housing 2 in the first and second embodiments is formed as a stationary vane support pressing face 2*d* in the third embodiment. The aforementioned stationary vanes 31 are supported by an annular stationary vane support member 32 which is loosely fitted to the inside periphery of the housing 2. Besides, an upper sliding member 9 is retained between the upper end face of the stationary vane support member 32 and the aforementioned stationary vane support member pressing face 2*d* formed on the bottom face of the upper of the housing 2. A stator 108 is so designed as to engage with the lower end face of the stationary vane support member 32 and to be capable of sliding circumferentially together with the stationary vane support member 32.

In the case of the multiple-type vacuum pump 101 as such, the outside diameter of the screw thread 28 is designed to be smaller than the outside diameter of each of the rotor vanes 30. Therefore the thickness of the stator 108 provided on the outside periphery of the screw type pump gas transfer portion 25 can be so designed as to be larger than the thickness of the stator 8 of the example in FIG. 1. However, in the event that the stator 108 is simply so designed as to have a large wall thickness, then the weight thereof increases. In the case of the stator 108, therefore, the arrangement is such that a recess 33 is provided on the outside periphery thereof, thereby forming a comparatively large clearance r between the stator 108 and the housing 2.

Accordingly at the upper end and the lower end of the aforementioned stator 108 are provided an upper end positioned portion 108*a* and an lower end positioned portion 108*b*, respectively, each of which fits to the inside periphery of the aforementioned housing 2 and is positioned and supported in a plane perpendicular to the axis of the housing 2. In that part of the outside periphery of the stator 108 which is situated between the aforementioned upper end positioned portion 108*a* and the aforementioned lower end positioned portion 108*b* is provided a recess 33 which forms a clearance r between the outside periphery of the aforementioned stator 108 and the inside periphery of the aforementioned housing 2.

Therefore the vacuum pump 101 does not comprise any members which correspond to those members of the aforementioned first embodiment which serve to perform positioning in the direction perpendicular to the axis of the cylindrical stator 8, such as the tapered face 8*a* formed on the inside periphery of the lower end of the stator 8 or the engagement portion 2*c* formed at the upper end of the housing 2.

The other portions of the construction of the third embodiment are similar to the corresponding portions of the construction of the first embodiment shown in FIG. 1 given above.

Operation of Third Embodiment

With the multiple-type vacuum pump which is thus constructed, in the event that any foreign matter is caught between the rotor 122 and the stator 108 when the rotor 122 is rotating, then the stator 108 becomes united with the stationary vane support member 32 to rotate together with the rotor 122. In consequence, as in the case of the example shown in FIG. 1, the rotational speed of the rotor 122 decreases owing to the friction produced by the aforementioned rotation between the stationary vane support member 32 and the sliding member 9 and between the stator 108 and the sliding member 10.

Moreover, in the event that as a result of stress corrosion cracking or the like occurring to the rotor 122, the diameter of the rotor 122 expands during high-speed rotation thereof owing to centrifugal force, resulting in the stator 108 being pressed radially outward, then the stator 108 is deformed radially outward and starts rotating together with the stator 122. In this case, since a comparatively large clearance r is formed on the exterior of the stator 108, the stator 108 continues to rotate together with the rotor for a considerably long period of time before coming into contact with the inner surface of the housing 2. As a result, the rotor 122 is deprived of the rotational energy thereof owing to the deformation of the stator 108 and to the frictional resistance exerted by the sliding members 9 and 10, thereby decelerating gradually to come to a stop.

Thus, as in the case of the example shown in FIG. 1, instantaneous locking of the rotor 122 is prevented, and therefore the phenomena of the rotor 122 being broken through and of even the housing 2 being fractured in consequence are prevented.

Fourth Embodiment

Figure 4:
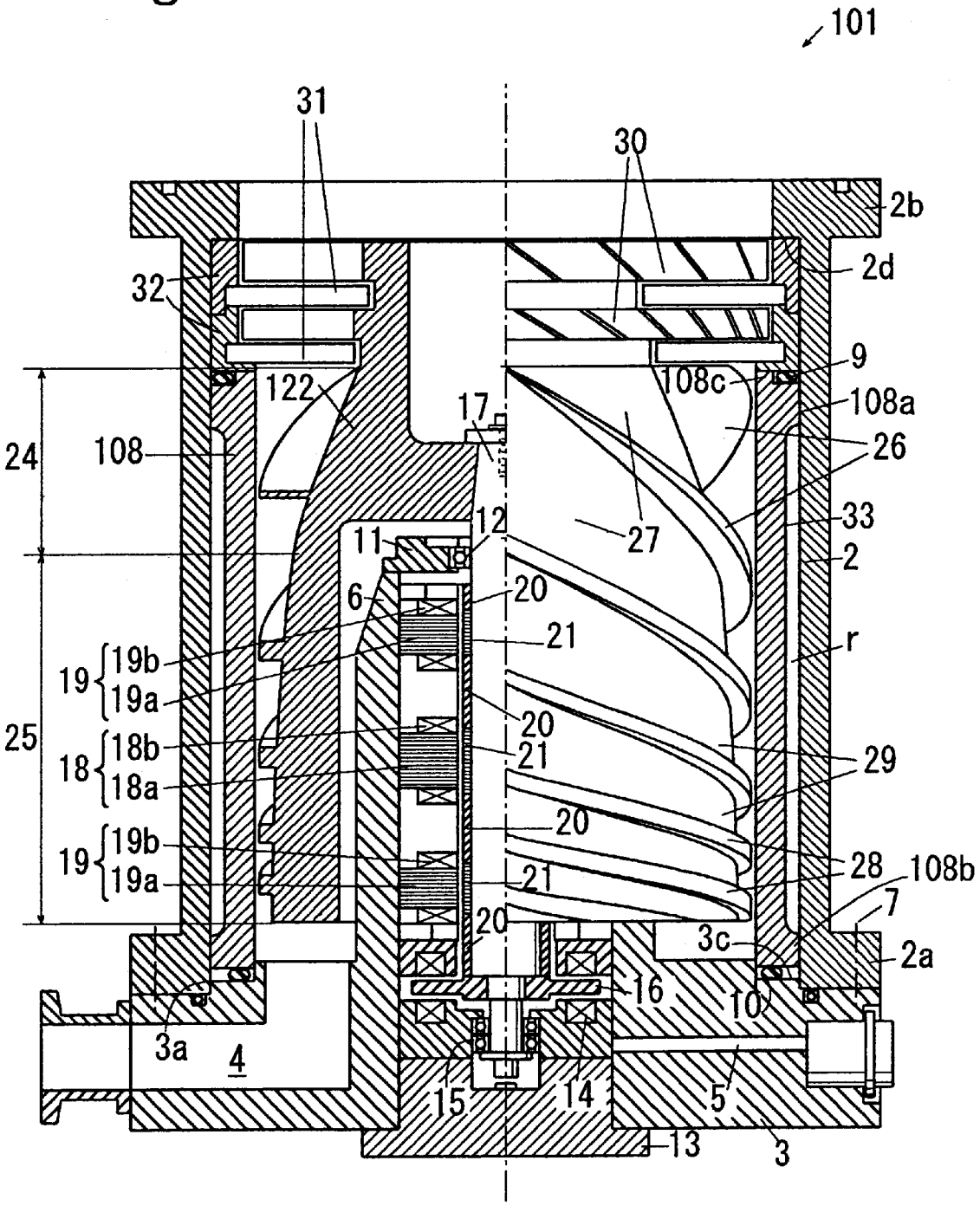
FIG. 4 is a longitudinal sectional view of the vacuum pump of the fourth embodiment of the present invention.

FIG. 4 is a longitudinal sectional view showing another example (the fourth embodiment) of a vacuum pump to which the present invention is applied.

This vacuum pump 101 differs from the vacuum pump 101 of the aforementioned third embodiment in that the sliding member 9 is disposed between the lower end of the stationary vane support member 32 and the upper end of the stator 108, whereas in the case of the aforementioned third embodiment, the sliding member 9 is disposed between the stationary vane support member pressing face 2*d* and the upper end of the stationary vane support member 32. Still another difference is that an annular protrusion 108*c* for positioning the aforementioned sliding member 9 is formed at the upper end of the stator 108. The other portions of the construction of the fourth embodiment are similar to the corresponding portions of the construction of the third embodiment shown in FIG. 3 given above.

The operation of the fourth embodiment differs from that of the third embodiment in that the stator 108 rotates, with the stationary vane support member 32 motionless, when the diameter of the rotor 122 enlarges owing to centrifugal force during high-speed rotation of the rotor 122 as a result of stress fatigue cracking or the like occurring to the rotor 122. In all the other respects, the operation performed by the fourth embodiment is similar to that carried out by the aforementioned third embodiment.

Fifth Embodiment

Figure 5:
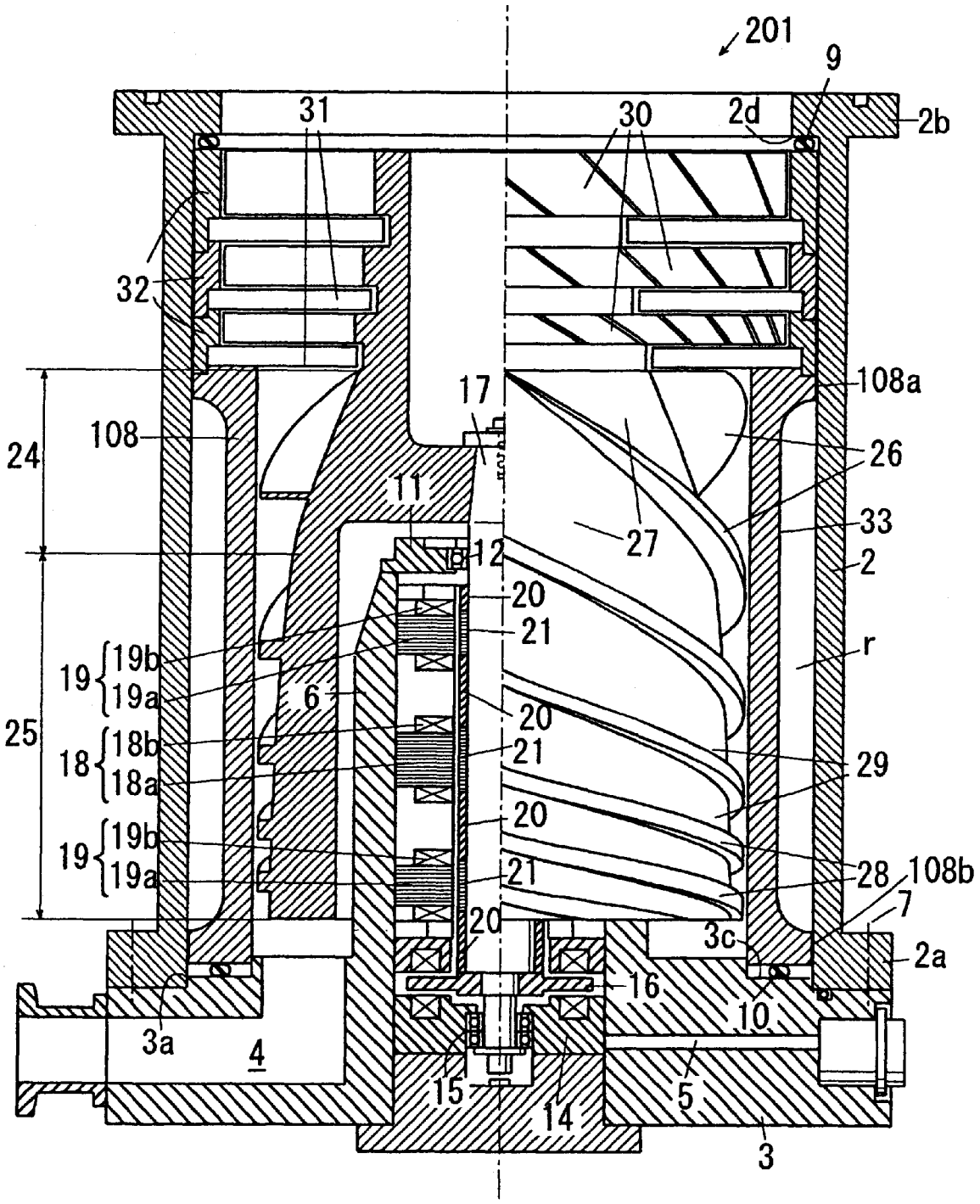
FIG. 5 is a longitudinal sectional view of the vacuum pump of the fifth embodiment of the present invention.

FIG. 5 is a longitudinal sectional view showing the fifth embodiment pertaining to a vacuum pump to which the present invention is applied.

This vacuum pump 201 is the same as the multiple-type vacuum pump 101 shown in FIG. 3, except that the number of stages pertaining to the rotor vanes 30 and to the stationary vanes 31, in the turbo molecular pump portion, is larger than in FIG. 3.

As is apparent from a comparison between FIG. 3 and FIG. 5, in the case of a multiple-type vacuum pump of this kind, the larger the number of stages pertaining to the rotor vanes 30 and to the stationary vanes 31 is in the turbo molecular pump portion, the greater the difference is, in the screw type pump gas transfer portion, between the outside diameter of the rotor 122 and the outside diameter of each of the rotor vanes 30. Therefore by increasing the aforementioned number, the depth of the recess 33 formed on the outside periphery of the stator 108 can be increased, thus making it possible to enlarge the clearance r, formed by the recess 3 3, between the stator 108 and the housing 2. In the case of the vacuum pump 201 shown in FIG. 5, the clearance r is so descend as to be approximately 10 mm.

It may be apparent that the vacuum pump 201 as such carries similar advantages in operation to those of the vacuum pump 101 shown in FIG. 3.

Various Modifications

It should be noted that in each of the examples mentioned above, the arrangement is such that the screw groove is provided on the outside periphery of the rotor. However, it is also possible for the screw groove to be so designed as to be provided on the inside periphery of the stator.

Furthermore, in each of the examples mentioned above, the gas transfer portion formed on the outside periphery of the rotor is so designed as to consist of the turbo-molecular type gas transfer portion 24 and the screw type pump type gas transfer portion 25. However, it is also possible to apply the present invention to a prior art general screw type vacuum pump whose gas transfer portion consists only of a screw type pump transfer portion.

In the aforementioned third embodiment, it is possible to dispose the sliding member 9 between the lower end face of the stationary vane support member 32 and the upper end face of the stator 108. In this case, the upper end face and the lower end face of the stator 108 are supported by the stationary vane 32 and by the base 3 with the sliding members 9 and 10 interposed in-between, respectively.

As is apparent from the aforementioned description, the arrangement according to the present invention is such that a clearance is provided between a housing of a vacuum pump having a screw groove and a stator supported inside the housing in such a way as to permit rotation. Therefore, in the event that part of the rotor comes into contact with the stator as a result of the rotor becoming fractured or deformed during high-speed rotation, even then the stator is prevented from coming into contact with the housing, thus being permitted to start rotating together with the stator. Accordingly the rotor and the stator continue to rotate together with each other, and the rotational speed decreases gradually owing to the rotational resistance of the stator. Thus further severe fracturing of the rotor due to instantaneous locking of the rotor is prevented, and therefore the stator can be prevented from being broken through and moreover the phenomenon of even the housing (2) being fractured can be prevented.

Besides, it is sufficient to provide a clearance between the housing and the stator, and it is not necessary to provide large wall thickness to the stator or to the housing, thus making it possible to construct a vacuum pump of light overall weight.

What is claimed is:

1. A vacuum pump comprising:

a cylindrical stator which is provided inside a cylindrical housing and which is supported in such a way as to permit circumferential sliding; and a rotor which is provided inside said stator in such a way as to permit free rotation and which is set in rotational motion by a motor: wherein a screw groove is formed on the inside periphery of said stator or on the outside periphery of said rotor; and between said stator and said housing is provided a clearance which is large enough to allow said stator to deform radially outward, wherein a first sliding member which presses said stator from above is provided on the top face of said stator; and a second sliding member which presses said stator from below is provided on the bottom face of said stator.

2. A vacuum pump as recited in claim 1, wherein a turbo-molecular pump rotor vane is provided on the outside periphery of said rotor at a location gas-transfer-wise upstream of the portion where said screw groove is formed;

a stationary vane support member is provided at the gas-transfer-wise upstream end of said stator; and a turbo-molecular pump stationary vane which corresponds to said rotor vane is provided on the inside periphery of said stationary vane support member.

3. A vacuum pump as recited in claim 2, wherein there are provided a plurality of stages comprising said rotor vanes, said stationary vanes, and said stationary vane support members.

4. A vacuum pump as recited in claim 2, wherein the construction is such that said stationary vane support member and said stationary vane combined are capable of sliding circumferentially together with said stator, as an integral assembly.

5. A vacuum pump as recited in claim 4, wherein at the upper end of said housing is provided a stationary vane pressing face serving to press the upper end of said stationary vane support member; and between the lower end face of said stator and a support face for said stator said second sliding member which is provided an O-ring-shaped sliding member; and between said stationary vane pressing face and the upper end face of said stationary vane is provided said first sliding member which is another O-ring-shaped sliding member.

6. A vacuum pump as recited in claim 2, wherein said stator is capable of circumferential sliding independently of said stationary vane support member and of said stationary vane.

7. A vacuum pump as recited in claim 6, wherein at the upper end of said housing is provided a stationary vane support member pressing surface serving to press the upper end of said stationary vane support member;

between the lower end face of said stator and a support face for said stator is disposed an O-ring-shaped sliding member; and between the lower end face of said stationary vane support member and the upper end face of said stator is disposed another O-ring-shaped sliding member.

8. vacuum pump as recited in claim 1, further comprising:

a base including:

a housing positioning portion serving to position and support one axial end of said cylindrical housing in a plane perpendicular to the axis of said housing, a stator positioning portion serving to position and support one axial end of said stator in a plane perpendicular to the axis of said stator, and a stator support face, wherein at the upper end of said housing are provided a stator pressing face, and a positioning engagement portion which engages with the outside periphery of the upper end of said stator to position the upper end of the stator;

wherein a first O-ring-shaped sliding member is disposed between the lower end face of said stator and a support face for said stator; and a second O-ring-shaped sliding member is disposed between said stator pressing face and the upper end face of said stator.

9. A vacuum pump as recited in claim 1, further comprising:

a base including:

a housing positioning portion serving to position and support one axial end of said cylindrical housing in a plane perpendicular to the axis of said housing, and a stator support face, wherein said stator includes:

an upper end positioned portion and a lower end positioned portion which are formed at the upper end and the lower end, respectively, of said housing, and which fit to the inside periphery of said housing to be positioned and supported in a plane perpendicular to the axis of said housing, and a recess which is formed in that area of the outside periphery of said stator which is situated between said upper end positioned portion and said lower end positioned portion and which serves to form a clearance between the outside periphery of said stator and the inside periphery of said housing;

wherein at the upper end of said housing is provided a stator pressing face formed opposite to the upper end face of said stator;

wherein a first O-shaped sliding member is disposed between said stator support face and the lower end face of said stator; and a second O-shaped sliding member is disposed between said stator pressing face and the upper end face of said stator.

10. A vacuum pump comprising:

a cylindrical stator which is provided inside a cylindrical housing and which is supported in such a way as to permit circumferential sliding; and a rotor which is provided inside said stator in such a way as to permit free rotation and which is set in rotational motion by a motor: wherein a screw groove is formed on the inside periphery of said stator or on the outside periphery of said rotor; and between said stator and said housing is provided a clearance which is large enough to allow said stator to deform radially outward, wherein a turbo-molecular pump rotor vane is provided on the outside periphery of said rotor at a location gas-transfer-wise upstream of the portion where said screw groove is formed;

wherein a stationary vane support member is provided at the gas-transfer-wise upstream end of said stator;

wherein a turbo-molecular pump stationary vane which corresponds to said rotor vane is provided on the inside periphery of said stationary vane support member; and wherein the construction is such that said stationary vane support member and said stationary vane combined are capable of sliding circumferentially together with said stator, as an integral assembly.

11. A vacuum pump as recited in claim 10, wherein at the upper end of said housing is provided a stationary vane pressing face serving to press the upper end of said stationary vane support member;

between the lower end face of said stator and a support face for said stator is provided an O-ring-shaped sliding member; and between said stationary vane pressing face and the upper end face of said stationary vane is provided another O-ring-shaped sliding member.

12. vacuum pump as recited in claim 10, further comprising:

a base including:

a housing positioning portion serving to position and support one axial end of said cylindrical housing in a plane perpendicular to the axis of said housing, a stator positioning portion serving to position and support one axial end of said stator in a plane perpendicular to the axis of said stator, and a stator support face, wherein at the upper end of said housing are provided a stator pressing face, and a positioning engagement portion which engages with the outside periphery of the upper end of said stator to position the upper end of the stator;

wherein a first O-ring-shaped sliding member is disposed between the lower end face of said stator and a support face for said stator; and a second O-ring-shaped sliding member is disposed between said stator pressing face and the upper end face of said stator.

13. A vacuum pump as recited in claim 10, further comprising:

a base including:

a housing positioning portion serving to position and support one axial end of said cylindrical housing in a plane perpendicular to the axis of said housing, and a stator support face, wherein said stator includes:

an upper end positioned portion and a lower end positioned portion which are formed at the upper end and the lower end, respectively, of said housing, and which fit to the inside periphery of said housing to be positioned and supported in a plane perpendicular to the axis of said housing, and a recess which is formed in that area of the outside periphery of said stator which is situated between said upper end positioned portion and said lower end positioned portion and which serves to form a clearance between the outside periphery of said stator and the inside periphery of said housing;

wherein at the upper end of said housing is provided a stator pressing face formed opposite to the upper end face of said stator;

wherein a first O-ring-shaped sliding member is disposed between said stator support face and the lower end face of said stator; and wherein a second O-ring-shaped sliding member is disposed between said stator pressing face and the upper end face of said stator.

* * * * *